US010747131B2

(12) United States Patent
Watanabe et al.

(10) Patent No.: US 10,747,131 B2
(45) Date of Patent: Aug. 18, 2020

(54) ELECTROPHOTOGRAPHIC PHOTOSENSITIVE MEMBER AND METHOD FOR MANUFACTURING THE SAME AS WELL AS PROCESS CARTRIDGE AND ELECTROPHOTOGRAPHIC IMAGE-FORMING APPARATUS

(71) Applicant: CANON KABUSHIKI KAISHA, Tokyo (JP)

(72) Inventors: Hiroyuki Watanabe, Suntou-gun (JP); Tsutomu Nishida, Mishima (JP); Yuka Ishiduka, Suntou-gun (JP); Atsushi Okuda, Yokohama (JP); Hideharu Shimozawa, Numazu (JP); Nobuhiro Nakamura, Numazu (JP); Daisuke Miura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/423,326

(22) Filed: May 28, 2019

(65) Prior Publication Data

US 2019/0369517 A1 Dec. 5, 2019

(30) Foreign Application Priority Data

May 31, 2018 (JP) ..... 2018-105587

(51) Int. Cl.

| | |
|---|---|
| ***G03G 5/147*** | (2006.01) |
| ***G03G 5/14*** | (2006.01) |
| ***G03G 15/01*** | (2006.01) |

(52) U.S. Cl.

CPC ..... *G03G 5/14791* (2013.01); *G03G 5/142* (2013.01); *G03G 5/147* (2013.01); *G03G 5/14717* (2013.01); *G03G 15/0147* (2013.01)

(58) Field of Classification Search

CPC . G03G 5/14791; G03G 5/14717; G03G 5/142

See application file for complete search history.

(56) References Cited

U.S. PATENT DOCUMENTS

| | | |
|---|---|---|
| 6,991,881 B2 | 1/2006 | Ogaki et al. |
| 6,994,941 B2 | 2/2006 | Tanaka et al. |

(Continued)

FOREIGN PATENT DOCUMENTS

| | | |
|---|---|---|
| JP | 2010-066672 | 3/2010 |
| JP | 2017-161718 | 9/2017 |

OTHER PUBLICATIONS

U.S. Appl. No. 16/423,337, Yuka Ishiduka, filed May 28, 2019.

(Continued)

*Primary Examiner* — Thorl Chea

(74) *Attorney, Agent, or Firm* — Venable LLP

(57) ABSTRACT

To provide an electrophotographic photosensitive member which does not cause film exfoliation in long-term use. An electrophotographic photosensitive member, having: a support; a layered photosensitive layer; and a protective layer in this order, wherein the protective layer is a single layer, the protective layer includes: at least two specific structures, the two specific structures are included in the protective layer at a mass ratio of 20% or more and 240% or less, and a peak area based on in-plane deformation vibration of terminal olefin ($CH_2$=) of the protective layer and a peak area based on stretching vibration of C=O of acryloyloxy groups, the peak areas being determined by total reflection Fourier transform infrared spectroscopy under conditions where an internal reflection element is Ge, and an incidence angle is 45°, have a fixed relationship.

7 Claims, 1 Drawing Sheet

(56) References Cited

U.S. PATENT DOCUMENTS

| | | | |
|---|---|---|---|
| 7,001,699 | B2 | 2/2006 | Tanaka et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,799,496 | B2 | 9/2010 | Uesugi et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,632,935 | B2 | 1/2014 | Sugiyama et al. |
| 8,669,027 | B2 | 3/2014 | Anezaki et al. |
| 8,753,789 | B2 | 6/2014 | Ogaki et al. |
| 8,765,335 | B2 | 7/2014 | Tanaka et al. |
| 8,815,479 | B2 | 8/2014 | Shida et al. |
| 8,846,281 | B2 | 9/2014 | Okuda et al. |
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,256,145 | B2 | 2/2016 | Fujii et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,341,964 | B2 | 5/2016 | Ogaki et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,436,107 | B2 | 9/2016 | Murakami et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,575,422 | B2 | 2/2017 | Okuda et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,791,972 | B2 | 10/2017 | Miyauchi et al. |
| 9,851,646 | B2 | 12/2017 | Tomono et al. |
| 9,869,032 | B2 | 1/2018 | Kawahara et al. |
| 2005/0208402 | A1 | 9/2005 | Tanaka et al. |
| 2010/0119260 | A1* | 5/2010 | Egawa ..... G03G 5/075 399/159 |
| 2014/0004450 | A1 | 1/2014 | Tokimitsu et al. |
| 2014/0093281 | A1 | 4/2014 | Takahashi et al. |
| 2014/0212800 | A1 | 7/2014 | Miura et al. |
| 2015/0185630 | A1 | 7/2015 | Ito et al. |
| 2015/0185634 | A1 | 7/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0060008 | A1 | 3/2017 | Okuda et al. |
| 2018/0059558 | A1 | 3/2018 | Ito et al. |
| 2018/0341190 | A1 | 11/2018 | Nishi et al. |
| 2019/0163118 | A1 | 5/2019 | Iwasaki et al. |
| 2019/0163119 | A1 | 5/2019 | Yamaai et al. |
| 2019/0163120 | A1 | 5/2019 | Miura et al. |

OTHER PUBLICATIONS

U.S. Appl. No. 16/423,381, Atsushi Okuda, filed May 28, 2019.
U.S. Appl. No. 16/423,393, Tsutomu Nishida, filed May 28, 2019.
U.S. Appl. No. 16/423,418, Hiroyuki Watanabe, filed May 28, 2019.
U.S. Appl. No. 16/423,429, Nobuhiro Nakamura, filed May 28, 2019.
U.S. Appl. No. 16/272,268, Hideharu Shimozawa, filed Feb. 11, 2019.
U.S. Appl. No. 16/286,762, Nobuhiro Nakamura, filed Feb. 27, 2018.
U.S. Appl. No. 16/287,102, Tsutomo Nishida, filed Feb. 27, 2019.
U.S. Appl. No. 16/423,292, Yasutaka Yagi, filed May 28, 2019.

* cited by examiner

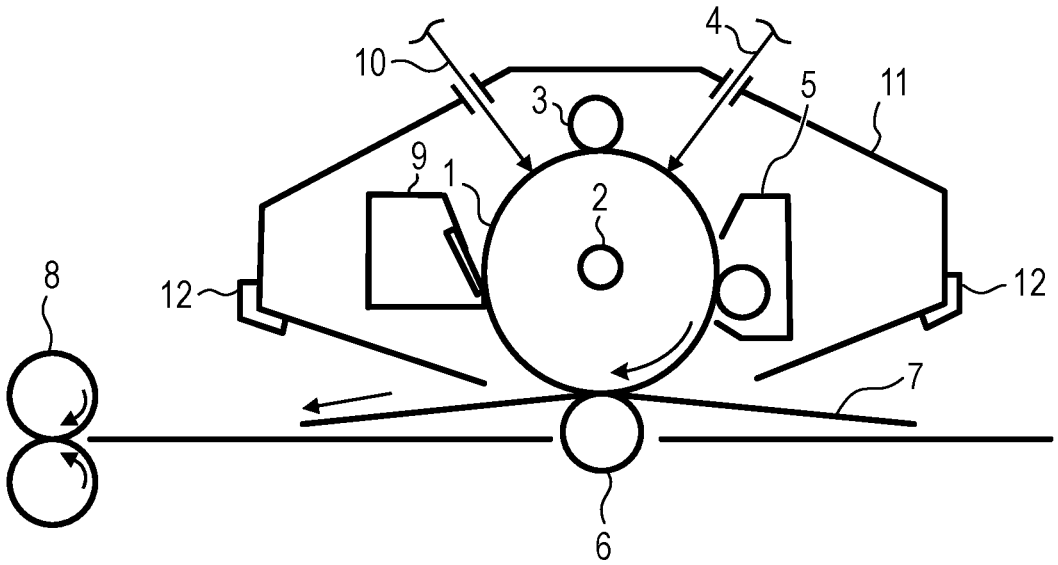
10
4
3
5
11
9
1
2
8
12
12
7
6

ELECTROPHOTOGRAPHIC PHOTOSENSITIVE MEMBER AND METHOD FOR MANUFACTURING THE SAME AS WELL AS PROCESS CARTRIDGE AND ELECTROPHOTOGRAPHIC IMAGE-FORMING APPARATUS

BACKGROUND OF THE INVENTION

Field of the Invention

The present disclosure relates to an electrophotographic photosensitive member and a method for manufacturing the same as well as a process cartridge having the electrophotographic photosensitive member and an electrophotographic image-forming apparatus.

Description of the Related Art

Electrophotographic photosensitive members with which electrophotographic image-forming apparatuses (hereinafter also called "electrophotographic apparatuses") are equipped have been widely examined so far to improve sensitivity and abrasion resistance. As an example thereof, the sensitivity and the abrasion resistance have been improved by using and curing a charge transport material having radical polymerization groups for the upper layer of the charge transport layer of an electrophotographic photosensitive member as a protective layer.

In the case of a layered photosensitive member, when the difference between the elastic deformation rates of the upper layer and the lower layer is large, the interface is distorted, and film exfoliation easily occurs. Due to few polar functional groups, a high elastic deformation rate and the like, especially the crosslinked cured film is easily exfoliated.

To solve this problem, in Japanese Patent Application Laid-Open No. 2010-66672, the durability is enhanced by adjusting the curability of the interface of the crosslinked cured film.

In Japanese Patent Application Laid-Open No. 2017-161718, the contact angle of the lower layer and the elastic deformation rate of the upper layer are adjusted, resulting in the suppression of film exfoliation.

SUMMARY OF THE INVENTION

The above-mentioned object is achieved by the following present disclosure. That is, an electrophotographic photosensitive member according to the present disclosure is an electrophotographic photosensitive member, having: a support; a layered photosensitive layer; and a protective layer in this order, wherein the protective layer is a single layer, the protective layer includes: a structure represented by formula I; and a structure represented by formula II, the structure represented by formula I is included in the protective layer at a mass ratio of 20% or more and 240% or less based on the structure represented by formula II, and an A value determined by total reflection Fourier transform infrared spectroscopy under conditions where an internal reflection element is Ge, and an incidence angle is 45° and expressed by the following expression (1) satisfies the following expression (2) to expression (4), Formula (I)

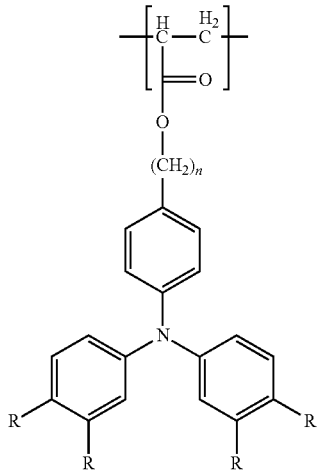

Formula (II)

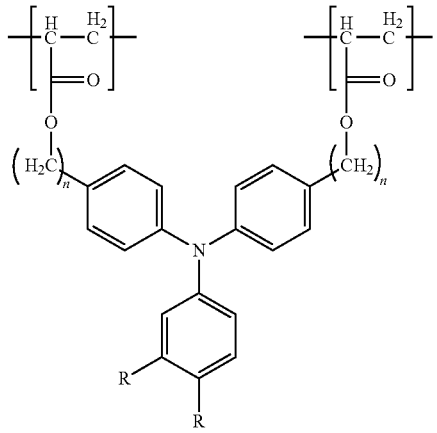

wherein, in formula I and formula II, each R is independently a hydrogen atom or a methyl group, and each n is independently an integer of 2 to 5, $$A=S1/S2 \quad (1)$$

wherein, in expression 1, S1 is a peak area based on in-plane bending vibration of terminal olefin ($CH_2$=), and S2 is a peak area based on stretching vibration of C=O of acryloyloxy groups, $$0.003 \leq A1 \leq 0.023 \quad (2)$$

$$0.005 \leq A2 \leq 0.030 \quad (3)$$

$$0.2 \leq A1/A2 \leq 0.97 \quad (4)$$

wherein, in expression (2) to expression (4), A1 is an A value determined from a surface side in the protective layer, and A2 is an A value determined from a side on which an interface with the layered photosensitive layer exists in the protective layer.

Another aspect of the present disclosure is a method for manufacturing the electrophotographic photosensitive member, having:

preparing a coating liquid for the protective layer; applying the coating liquid to form a coated film; irradiating the coated film with an electron beam; and curing the coated film by heating, in the irradiation with an electron beam, an accelerating voltage of the electron beam is 40 kV or more and 70 kV or less, and a distance between a surface of the coated film and an irradiation window foil of an electron beam irradiation apparatus is 10 mm or more and 40 mm or less so that an electron beam absorbed dose of the surface of the coated film is 5 kGy or more and 45 kGy or less, in the curing by heating, a final temperature of heating temperature is 100° C. or more and 150° C. or less, and the method includes performance of the irradiation with an electron beam and the curing by heating at an oxygen concentration of 300 ppm or less.

Yet another aspect of the present disclosure is a process cartridge, wherein the process cartridge integrally supports the electrophotographic photosensitive member and at least one unit selected from the group consisting of a charging unit, a development unit and a cleaning unit, and is detachably attachable to a main body of an electrophotographic apparatus.

Yet another aspect of the present disclosure is an electrophotographic image-forming apparatus, having: the electrophotographic photosensitive member; and at least one unit selected from the group consisting of a charging unit, an exposure unit, a development unit, and a transfer unit.

Further features of the present disclosure will become apparent from the following description of exemplary embodiments with reference to the attached drawing.

BRIEF DESCRIPTION OF THE DRAWINGS

FIG. 1 is a schematic diagram of an electrophotographic image-forming apparatus having a process cartridge including an electrophotographic photosensitive member according to one embodiment of the present disclosure.

DESCRIPTION OF THE EMBODIMENTS

Preferred embodiments of the present disclosure will now be described in detail in accordance with the accompanying drawing.

As a result of the examination of the present inventors, it has been found that the configurations disclosed in Japanese Patent Application Laid-Open No. 2010-66672 or Japanese Patent Application Laid-Open No. 2017-161718 may be insufficient to suppress the film exfoliation between the charge transport layer and the protective layer.

An object of the present disclosure is to provide an electrophotographic photosensitive member which does not cause film exfoliation in long-term use and a method for manufacturing the electrophotographic photosensitive member efficiently.

The present disclosure will be described in detail by mentioning preferred embodiments below.

Since the protective layer of a photosensitive member and a charge transport layer which a layered photosensitive layer has have a large difference in the elastic modulus, the interface between the protective layer and the charge transport layer is distorted by external stress, and film exfoliation occurs easily. A method for reducing the elastic modulus of the protective layer exists to solve this. However, when the elastic modulus is reduced too much, the mold releasability between the protective layer and another member, for example, a cleaning blade, decreases. Therefore, the protective layer is tight pulled, and film exfoliation occurs. Then, in the present disclosure, forming a cured product wherein the structure represented by formula I is included in the protective layer at a mass ratio of 20% or more and 240% or less based on the structure represented by formula II into a single layer protective layer wherein the A value expressed by expression (1) satisfies expressions (2) to (4) reduces the difference in the elastic modulus on the interface between the protective layer and the charge transport layer while satisfactory mold releasability between the protective layer and another member is maintained, promotes the reinforcement of interaction on the interface between the protective layer and the charge transport layer, and suppresses film exfoliation. This mechanism will be described.

Formula (I)

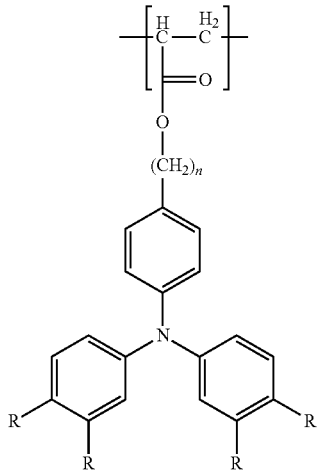

Formula (II)

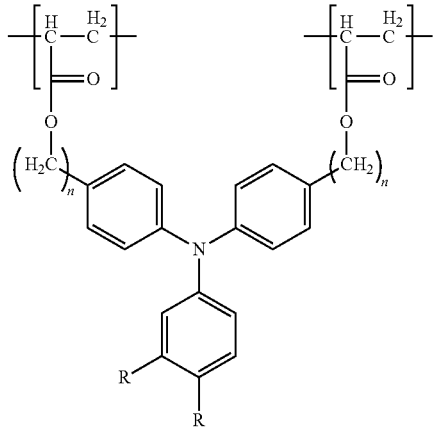

In formula I and formula II, each R is independently a hydrogen atom or a methyl group, and each n is independently an integer of 2 to 5.

It is considered that when a composition including the structure represented by formula I and the structure represented by formula II is cured, curing on the protective layer surface side proceeds more easily than curing on the side on which the interface with the charge transport layer exists. This is because since the structure represented by formula I has smaller steric hindrance than the structure represented by formula II, the structure represented by formula I has the characteristic of moving to the protective layer surface side in a wet film easily and advancing curing easily. Meanwhile, since the structures represented by formula II having large steric hindrance gather on the side on which the interface with the charge transport layer exists, curing hardly proceeds. This reduces the elastic modulus on only the side on which the interface of the protective layer with the charge transport layer exists, promotes interaction with the charge transport layer by unreacted acryloyloxy groups (hereinafter also called "remaining functional groups") in addition, and improves the adhesion between the protective layer and the charge transport layer. The protective layer including the structure represented by formula I and the structure represented by formula II is more resistant to film exfoliation than a protective layer including only the structure represented by formula II. Although the reason for this is not certain, it is presumed that since the remaining functional groups having the structure represented by formula II are easily oriented in the direction perpendicular to the charge transport layer by the influence of the structure represented by formula I, stronger interaction occurs.

The curability which can exhibit these effects to the maximum has been examined and consequently found that it is important that the value of A1 is controlled in the range of 0.003 or more and 0.023 or less, the value of A2 is controlled in the range of 0.005 or more and 0.030 or less, and the ratio of the value of A1 to the value of A2 is controlled in the range of 0.2 or more and 0.97 or less. The A value expressed by the value of A1 and the value of A2 means the ratio of the peak area S1 based on the in-plane bending vibration of terminal olefin ($CH_2$=) to the peak area S2 based on the stretching vibration of C=0 of acryloyloxy groups, obtained by measuring the protective layer using total reflection Fourier transform infrared spectroscopy under the conditions where the internal reflection element is Ge, and the incidence angle is 45° . The A1 is an A value based on the S1 and the S2 determined from the surface side of the protective layer, and the A2 is an A value based on the S1 and the S2 determined from the side on which the interface with the charge transport layer exists in the protective layer. The A value means the existence rate of the unreacted acryloyloxy group. It can be said that as the numerical value becomes smaller, curing has proceeded. When the value of the A1 is less than 0.003, curing proceeds too much, the elastic modulus is high, and the adhesion between the protective layer and the charge transport layer decreases. When the value of the A1 is more than 0.023, the increase in the remaining functional group of the protective layer surface increases the surface energy of the protective layer and reduces the mold releasability from another member. Since the protective layer is pulled tight by the other member, the adhesion between the protective layer and the charge transport layer decreases. When the value of the A2 is less than 0.005, a decrease in the remaining functional group weakens interaction with the charge transport layer, and reduces the adhesion between the protective layer and the charge transport layer. When the value of the A2 is more than 0.030, a film is weakened and the adhesion between the protective layer and the charge transport layer decreases. When the value of the A1/A2 is less than 0.2, the difference in the elastic-modulus between the surface side and the interface side of the protective layer increases. Therefore, the stress distortion of the protective layer by external stress increases, and the adhesion between the protective layer and the charge transport layer decreases. When the value of the A1/A2 is more than 0.97, the effect of reducing mold releasability from the other member due to an increase in the surface energy of the protective layer exceeds the effect of improving the adhesion due to interaction on the interface between the protective layer and the charge transport layer, and film exfoliation occurs. Controlling the value of the A1 in the range of 0.003 or more and 0.020 or less, the value of the A2 in the range of 0.008 or more and 0.024 or less, and the value of the A1/A2 in the range of 0.3 or more and 0.85 or less exhibits the effect of the present disclosure more strongly. It is considered that controlling the value of the A1/A2 in the range of 0.3 or more brings the curability on the surface side and the curability on the interface side of the protective layer close, stress relaxation in the protective layer is performed smoothly, the distortion of the protective layer by external stress is small, and therefore the adhesion between the protective layer and the charge transport layer is improved. It is considered that controlling the value of the A1/A2 in the range of 0.85 or less keeps the mold releasability between a surrounding member and the protective layer, interaction of the interface between the protective layer and the charge transport layer, and the stress distortion of the protective layer in the optimal balance. When the value of A1/A2 is controlled in the range of 0.3 or more and 0.69 or less, the above-mentioned effects are still stronger.

When the value of the A1 and the value of the A2 are controlled, a method for layering protective layers is considered. However, the interface between a first protective layer and a second protective layer is a starting point of film exfoliation in this method. Therefore, the protective layer in the present disclosure needs to be a single layer.

A method for measuring the protective layer of the electrophotographic photosensitive member of the present disclosure using total reflection Fourier transform infrared spectroscopy (hereinafter called an "ATR method") will be described below.

The ATR method is a method for performing measurement by adhering a sample to a crystal called an internal reflection element (hereinafter called an "IRE") and having a higher refractive index than the sample, and making infrared light enter the crystal at a higher incidence angle than the critical angle. The method is a method using total reflection caused by making slight infrared light entering the sample side of the interface between the sample and the crystal.

In the ATR method, it is the refractive index of the IRE and the incidence angle of the optical path which determines the depth to which infrared light enters the sample side (detection depth). The A value in the present disclosure is measured under the conditions where the IRE is Ge (refractive index 4.0), and the incidence angle is 45°. The degree of polymerization nearer to the surface is calculated thereby.

In measurement in the ATR method, it is important that the noise level of the spectrometer is lowered, and it is necessary for that purpose using a highly sensitive spectrometer, increasing the number of scans, and the like.

As the infrared spectrometer used in the present disclosure, an FT-IR having high frequency accuracy and photometric accuracy is used. The number of scans is more preferably 32 or more. When the number of scans is that or less, the influence of a noise is great, exact measurement may not be able to be performed.

The shape of the electrophotographic photosensitive member at the time of measurement by the ATR method may be any shape as long as the contact with the IRE is sufficiently maintained.

Formula I-1 to formula I-3, which are preferable examples of the structure represented by the above-mentioned formula I, will be illustrated below. Among these, the structures represented by formula I-1 and formula I-2 are more preferable.

Formula II-1 to formula II-3, which are preferable examples of the structure represented by the above-mentioned formula II, will be illustrated below. Among these, the structure represented by formula II-1 is more preferable.

Formula (I-1)

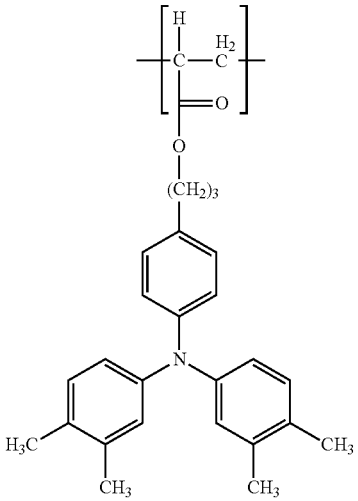

Formula (I-2)

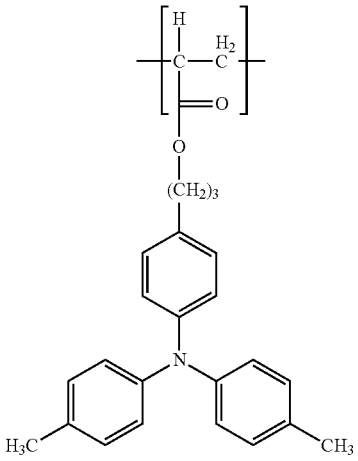

Formula (I-3)

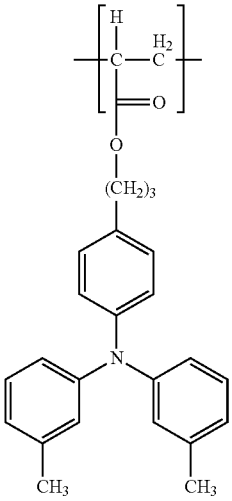

-continued

Formula (II-1)

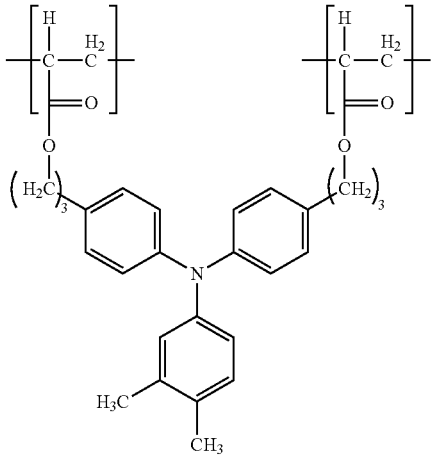

Formula (II-2)

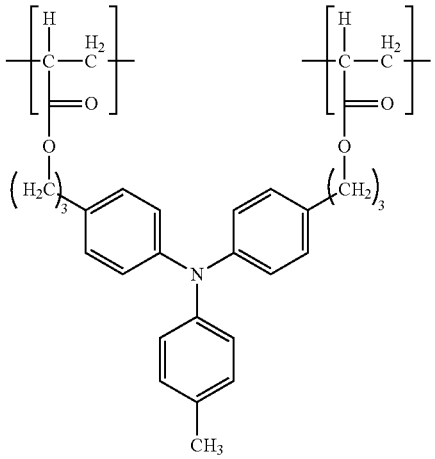

Formula (II-3)

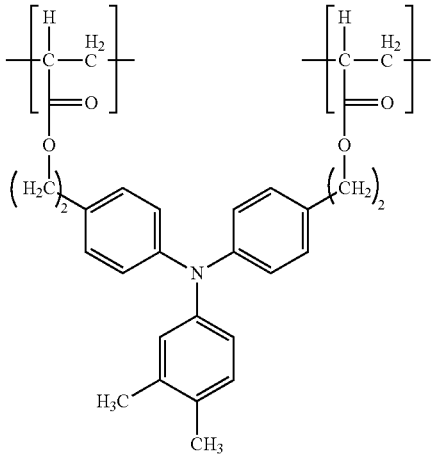

An effect of the present disclosure is exhibited more strongly in an electrophotographic photosensitive member wherein the sum of the average film thicknesses of the protective layer and the charge transport layer are 10 μm or more and 17 μm or less, and the ratio of the average film thickness of the protective layer to the sum of the average film thicknesses of the protective layer and the charge transport layer is 10% or more and 30% or less. As a result of examination of the present inventors, it has been found that the volume change of the protective layer by external stress increases, therefore distortion on the interface increases, and film exfoliation occurs easily when the ratio of the average film thickness of the protective layer to the sum of the average film thicknesses of the protective layer and the charge transport layer is more than 30% in the case where the sum of the average film thicknesses of the protective layer and the charge transport layer is 10 μm or more and 17 μm or less. It has been found that film exfoliation occurs easily also when the ratio of the average film thickness of the protective layer to the sum of the average film thicknesses of the protective layer and the charge transport layer is less than 10%. It is considered that it is because the interface is probably distorted easily by the stress derived from the curvature of the cylindrical pipe. Film thicknesses are measured at 8 points which are 135 mm lower than the upper end of the cylinder in the circumferential direction, and the average film thickness is the average value of the values thereof. Although any method may be used for measuring film thickness, a film thickness gauge using, for example, an eddy current method can be used. Examples of the film thickness gauge using an eddy current method include an LH-200J manufactured by Kett Electric Laboratory. The average film thicknesses of the protective layer and the charge transport layer were calculated as the difference before and after the film formation of the layers.

The manufacturing of the protective layer in the method for manufacturing the electrophotographic photosensitive member of the present disclosure is preferably a method having: preparing a coating liquid for the protective layer; applying the coating liquid to form a coated film; irradiating the coated film with an electron beam; and curing the coated film by heating, wherein, in the irradiation with an electron beam, an accelerating voltage of the electron beam is 40 kV or more and 70 kV or less, and a distance between a surface of the coated film and an irradiation window foil of an electron beam irradiation apparatus is 10 mm or more and 40 mm or less so that an electron beam absorbed dose of the surface of the coated film is 5 kGy or more and 45 kGy or less, in the curing by heating, the degree of the final temperature of heating temperature is 100° C. or more and 150° C. or less, and the method includes performance of the irradiation with an electron beam and the curing by heating at an oxygen concentration of 300 ppm or less.

In the manufacturing of the protective layer, electron beam curing in which curing depth can be controlled by accelerating voltage and irradiation distance is preferable to control the curing of the coated film in the depth direction of the film. The atmosphere of the irradiation with an electron beam and the curing by heating has preferably an oxygen concentration of 300 ppm or less, and particularly preferably an oxygen concentration of 100 ppm or less. When the oxygen concentration is more than 300 ppm, the curability may deteriorate.

In the irradiation with an electron beam, when the accelerating voltage of an electron beam is less than 40 kV, an electron beam penetrates the protective layer shallowly, and the protective layer is cured insufficiently, and therefore the abrasion resistance of the protective layer deteriorates. When the accelerating voltage of an electron beam is more than 70 kV, an electron beam penetrates the protective layer too deeply, curing is promoted on the side on which the interface between the protective layer and the charge transport layer exists, the interaction between the protective layer and a charge transport layer by the remaining functional groups weakens, and film exfoliation occurs easily. The accelerating voltage of an electron beam is more preferably 40 kV or more and 60 kV or less.

Further, when the electron beam absorbed dose of the surface of the coated film is less than 5 kGy, the curing of a coated film does not proceed. When the absorbed dose is more than 45 kGy, the photosensitive member characteristics deteriorate. The electron beam absorbed dose of the surface of the coated film is more preferably in the range of 10 kGy or more and 35 kGy or less.

The electron beam absorbed dose of the surface of the coated film can be measured with general-purpose film dosimeters, for example, a Radiachromic Reader and a Radiachromic Dosimeter (10 μm) manufactured by FarWest Technology, Inc.

In the present disclosure, the electron beam absorbed dose on the surface of a coated film is defined as an absorbed dose measured when the film of a Radiachromic Dosimeter (10 μm) stuck on the surface of the electrophotographic photosensitive member before the coating liquid for the protective layer is applied is irradiated with an electron beam.

Additionally, when the distance between the surface of the coated film and the irradiation window foil of the electron beam irradiation apparatus (irradiation distance) is less than 10 mm, an electron beam penetrates the protective layer deeply, curing on the interface side proceeds too much, the remaining functional groups decrease, and therefore the adhesion with the charge transport layer deteriorates. When the irradiation distance is more than 40 mm, an electron beam penetrates the protective layer shallowly, the curability of the protective layer is insufficient, and therefore the abrasion resistance of the protective layer deteriorates. Here, the distance between the surface of the coated film and the irradiation window foil of the electron beam irradiation apparatus refers to the shortest distance between the surface of the coated film and the irradiation window foil of the electron beam irradiation apparatus. In the electron beam irradiation apparatus, since degeneration (inactivation) starts after an electron beam passes through the irradiation window foil, the distance between the surface of the coated film and the radiation source is not prescribed, but the distance between the surface of the coated film and the irradiation window foil is prescribed in the present disclosure.

Additionally, in the manufacturing of the electrophotographic photosensitive member of the present disclosure, a coated film is formed into a protective layer by curing the coated film by heating after the coated film is irradiated with an electron beam. In the curing by heating, when the final temperature of heating temperature is less than 100° C., curing does not proceed sufficiently. When the final temperature of heating temperature is more than 150° C., a coating film is roughened. Therefore, the final temperature of the heating temperature is preferably 100° C. or more and 150° C. or less, and more preferably 110° C. or more and 130° C. or less.

The curing by heating is performed by raising the temperature from the initial temperature to the final temperature, and the temperature rise time is preferably 5 seconds or more and 60 seconds or less. At this time, the initial temperature of the curing by heating may be room temperature, or may be the temperature of the coated film after electron beam irradiation, the temperature of the coated film after electron beam irradiation is more preferable. When the temperature rise time is less than 5 seconds, since the temperature is raised too rapidly, the protective layer is deformed minutely at the time of curing. When the temperature rise time is more than 60 seconds, the charge transport layer is deformed minutely, and this has a harmful influence on the adhesion between the protective layer and the charge transport layer.

As the above mechanism, since constituents have effects on each other synergistically, an electrophotographic photosensitive member which enables achieving an effect of the present disclosure can be manufactured.

[Electrophotographic Photosensitive Member]

An electrophotographic photosensitive member according to one aspect of the present disclosure has a support, a layered photosensitive layer and a protective layer.

Examples of a method for manufacturing the electrophotographic photosensitive member of the present disclosure include a method of preparing the below-mentioned coating liquids for layers, applying the coating liquids in the desired order of layers and drying the coating liquids. Examples of the method of applying coating liquids at this time include dip coating, spray coating, inkjet coating, roll coating, die coating, blade coating, curtain coating, wire bar coating and ring coating. Among these, the dip coating is preferable from the viewpoint of efficiency and productivity.

The layers will be described hereafter.

<Support>

In the present disclosure, an electrophotographic photosensitive member has a support. In the present disclosure, it is preferable that the support is an electro-conductive support, which has electro-conductivity. Examples of the shape of the support include a cylindrical shape, a belt shape and a sheet shape. It is preferable that the support be especially a cylindrical support. Electrochemical treatment such as anodic oxidization; blasting processing; cutting processing or the like may be performed on the surface of the support.

As the material of the support, metal, resin, glass or the like is preferable.

Examples of the metal include aluminum, iron, nickel, copper, gold, stainless steel and alloys thereof. It is preferable that the support be especially a support made of aluminum.

Electro-conductivity may be imparted to the resin and the glass by treatment such as mixing the resin and the glass with an electro-conductive material or covering the resin and the glass with an electro-conductive material.

<Electro-Conductive Layer>

In the present disclosure, an electro-conductive layer may be provided on the support. The scratches and roughness on the surface of the support can be concealed and the reflection of light on the surface of the support can be controlled by providing an electro-conductive layer.

It is preferable that the electro-conductive layer contain an electro-conductive particle and a resin.

Examples of the material of electro-conductive particle include metal oxides, metals and carbon black.

Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

It is preferable that the metal oxide be used, and it is more preferable that especially titanium oxide, tin oxide or zinc oxide be used as an electro-conductive particle among these.

When the metal oxide is used as an electro-conductive particle, the surface of the metal oxide may be treated by a silane coupling agent or the like, or the metal oxide may be doped with an element such as phosphorus or aluminum, and an oxide thereof.

The electro-conductive particle may have a layered structure having a core material particle and a covering layer covering the particle. Examples of the core material particle include titanium oxide, barium sulfate and zinc oxide. Examples of the covering layer include metal oxides such as tin oxide.

When the metal oxide is used as an electro-conductive particle, the volume average particle size is preferably 1 nm or more and 500 nm or less, and more preferably 3 nm or more and 400 nm or less.

Examples of the resin include polyester resin, polycarbonate resin, polyvinyl acetal resin, acrylic resin, silicone resin, epoxy resin, melamine resin, polyurethane resin, phenolic resin and alkyd resin.

The electro-conductive layer may further contain a masking agent such as silicone oil, a resin particle or titanium oxide.

The average film thickness of the electro-conductive layer is preferably 1 μm or more and 50 μm or less, and particularly preferably 3 μm or more and 40 μm or less.

The electro-conductive layer can be formed by preparing a coating liquid for an electro-conductive layer, wherein the coating liquid contains the above-mentioned materials and a solvent, forming a coating film thereof and drying the coating film. Examples of the solvent used for the coating liquid include alcohol-based solvents, sulfoxide-based solvents, ketone-based solvents, ether-based solvents, ester-based solvents and aromatic hydrocarbon-based solvents. Examples of the method for dispersing the electro-conductive particle in the coating liquid for the electro-conductive layer include methods using a paint shaker, a sand mill, a ball mill or a liquid collision high-speed disperser.

<Undercoating Layer>

In the present disclosure, an undercoating layer may be provided on the support or the electro-conductive layer. An adhesion function between layers increases, and a charge injection prevention function can be imparted by providing the undercoating layer.

It is preferable that the undercoating layer contain a resin. The undercoating layer may be formed as a cured film by polymerizing a composition containing a monomer having a polymerizable functional group.

Examples of the resin include polyester resin, polycarbonate resin, polyvinyl acetal resin, acrylic resin, epoxy resin, melamine resin, polyurethane resin, phenolic resin, polyvinyl phenolic resin, alkyd resin, polyvinyl alcohol resin, polyethylene oxide resin, polypropylene oxide resin, polyamide resin, polyamide acid resin, polyimide resin, polyamide imide resin and cellulose resin.

Examples of the polymerizable functional group which the monomer having a polymerizable functional group has include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

The undercoating layer may further contain an electron transport substance, a metal oxide, a metal, an electro-conductive polymer or the like to improve electrical properties. It is preferable to use the electron transport substance and the metal oxide among these.

Examples of the electron transport substance include quinone compounds, imide compounds, benzimidazole compounds, cyclopentadienylidene compounds, fluorenone compounds, xanthone compounds, benzophenone compounds, cyanovinyl compounds, aryl halide compounds, silole compounds and boron-containing compounds. The electron transport substance having a polymerizable functional group is used as an electron transport substance. The undercoating layer may be formed as a cured film by copolymerizing the electron transport substance with the monomer having the above-mentioned polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The undercoating layer may further contain additives.

The average film thickness of the undercoating layer is preferably 0.1 μm or more and 50 μm or less, more preferably 0.2 μm or more and 40 μm or less, and particularly preferably 0.3 μm or more and 30 μm or less.

The undercoating layer can be formed by preparing a coating liquid for the undercoating layer, wherein the coating liquid contains the above-mentioned materials and a solvent, forming a coating film thereof, and drying and/or curing the coating film. Examples of the solvent used for the coating liquid include alcohol-based solvents, ketone-based solvents, ether-based solvents, ester-based solvents and aromatic hydrocarbon-based solvents.

<Photosensitive Layer>

The photosensitive layer of the electrophotographic photosensitive member is mainly classified into the layered photosensitive layer and the monolayer photosensitive layer. The electrophotographic photosensitive member of the present disclosure is a layered photosensitive layer having a charge-generating layer containing a charge-generating substance and a charge transport layer containing a charge transport sub stance.

(1) Charge-Generating Layers

It is preferable that the charge-generating layer contain a charge-generating substance and a resin.

Examples of the charge-generating substance include azo pigments, perylene pigments, polycyclic quinone pigments, an indigo pigment and phthalocyanine pigments. Among these, the azo pigments and the phthalocyanine pigments are preferable. Among the phthalocyanine pigments, an oxytitanium phthalocyanine pigment, a chlorogallium phthalocyanine pigment and a hydroxygallium phthalocyanine pigment are preferable.

The content of the charge-generating substance in the charge-generating layer is preferably 40% by mass or more and 85% by mass or less, and more preferably 60% by mass or more and 80% by mass or less based on the total mass of the charge-generating layer.

Examples of the resin include polyester resin, polycarbonate resin, polyvinyl acetal resin, polyvinyl butyral resin, acrylic resin, silicone resin, epoxy resin, melamine resin, polyurethane resin, phenolic resin, polyvinyl alcohol resin, cellulose resin, polystyrene resin, polyvinyl acetate resin and polyvinyl chloride resin. Among these, the polyvinyl butyral resin is more preferable.

The charge-generating layer may further contain additives such as an antioxidant and an ultraviolet absorber. Specific examples include hindered phenol compounds, hindered amine compounds, sulfur compounds, phosphorus compounds and benzophenone compounds.

The average film thickness of the charge-generating layer is preferably 0.1 μm or more and 1 μm or less, and more preferably 0.15 μm or more and 0.4 μm or less.

The charge-generating layer can be formed by preparing a coating liquid for the charge-generating layer, wherein the coating liquid contains the above-mentioned materials and a solvent, forming a coating film thereof and drying the coating film. Examples of the solvent used for the coating liquid include alcohol-based solvents, sulfoxide-based solvents, ketone-based solvents, ether-based solvents, ester-based solvents and aromatic hydrocarbon-based solvents.

(2) Charge Transport Layer

It is preferable that the charge transport layer contain a charge transport substance and a resin.

Examples of the charge transport substance include polycyclic aromatic compounds, heterocyclic compounds, hydrazone compounds, styryl compound, enamine compounds, benzidine compounds, triarylamine compounds and resins having groups derived from these substances. Among these, the triarylamine compounds and the benzidine compounds are preferable.

The content of the charge transport substance in the charge transport layer is preferably 25% by mass or more and 70% by mass or less, and more preferably 30% by mass or more and 55% by mass or less based on the total mass of the charge transport layer.

Examples of the resin include polyester resin, polycarbonate resin, acrylic resin and polystyrene resin. Among these, the polycarbonate resin and the polyester resin are preferable. As the polyester resin, especially polyarylate resin is preferable.

The content ratio (mass ratio) of the charge transport substance to the resin is preferably 4:10 to 20:10, and more preferably 5:10 to 12:10.

The charge transport layer may contain additives such as an antioxidant, an ultraviolet absorber, a plasticizer, a leveling agent, a slipperiness-imparting agent and an abrasion resistance-improving agent. Specific examples include hindered phenol compounds, hindered amine compounds, sulfur compounds, phosphorus compounds, benzophenone compounds, siloxane-modified resin, silicone oil, a fluororesin particle, a polystyrene resin particle, a polyethylene resin particle, a silica particle, an alumina particle and a boron nitride particle.

The average film thickness of the charge transport layer is preferably 5 μm or more and 30 μm or less, and more preferably 8 μm or more and 20 μm or less.

The charge transport layer can be formed by preparing a coating liquid for the charge transport layer, wherein the coating liquid contains the above-mentioned materials and a solvent, forming a coating film thereof and drying the coating film. Examples of the solvent used for the coating liquid include alcohol-based solvents, ketone-based solvents, ether-based solvents, ester-based solvents and aromatic hydrocarbon-based solvents. Among these solvents, the ether-based solvents and the aromatic hydrocarbon solvents are preferable.

<Protective Layer>

In the electrophotographic photosensitive member of the present disclosure, a surface layer which plays a role of a protective layer is provided on the layered photosensitive layer.

The protective layer includes the structures having charge transport capability and represented by formula I and formula II, and can be formed as a cured film by polymerizing compositions containing monomers having polymerizable functional groups corresponding to the structure represented by formula I and the structure represented by formula II. Examples of the reaction at the time of polymerizing monomers include thermal polymerization reaction, photopolymerization reaction and radiation polymerization reaction.

Examples of the monomers having the polymerizable functional groups corresponding to the structure represented by I and the structure represented by formula II include compounds represented by the following formula A-1 to formula A-10 and formula B-1 to formula B-6.

(A-1)
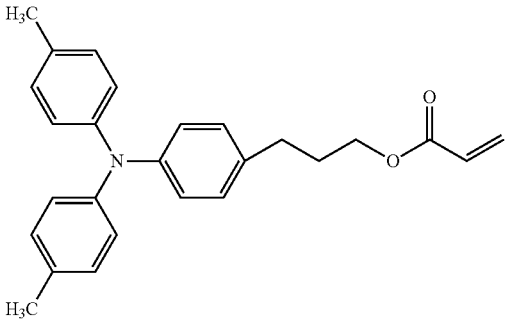
(A-2)
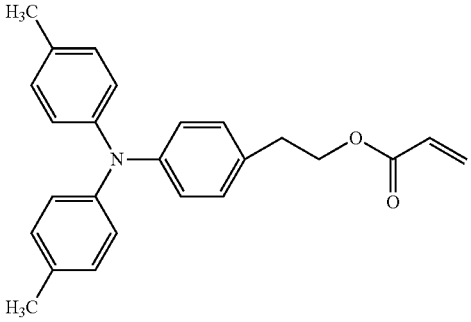
(A-3)
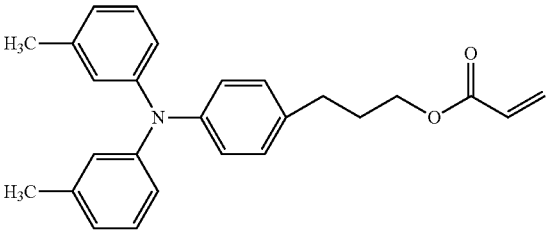
(A-4)
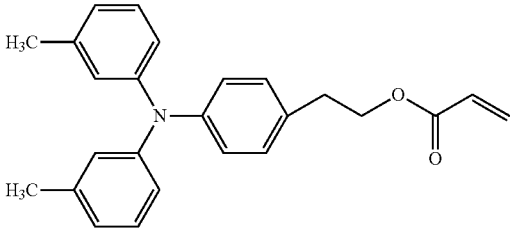
Formula (A-5)
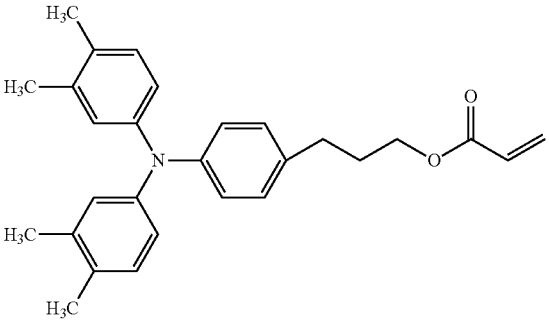
-continued
Formula (A-6)
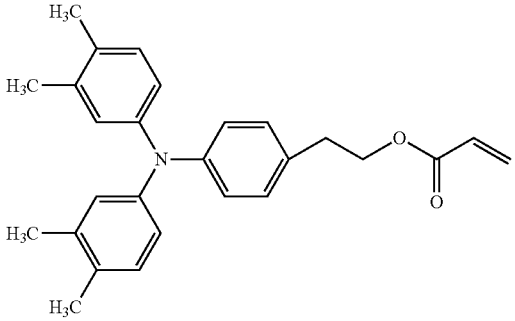
Formula (A-7)
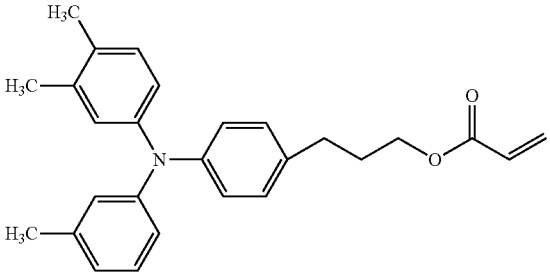
Formula (A-8)
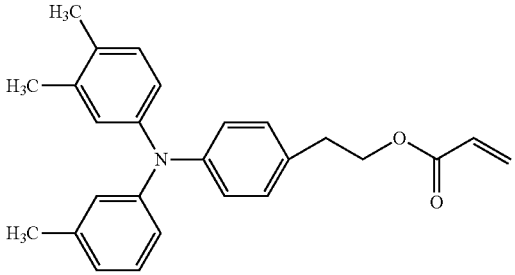
Formula (A-9)
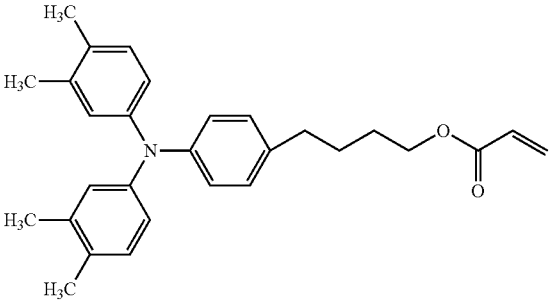
Formula (A-10)
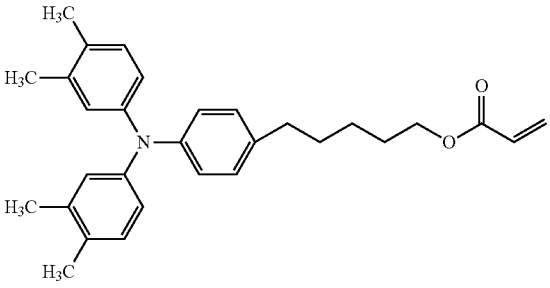

-continued

Formula (B-1)

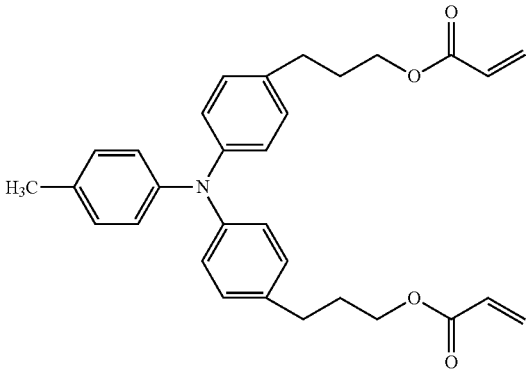

Formula (B-2)

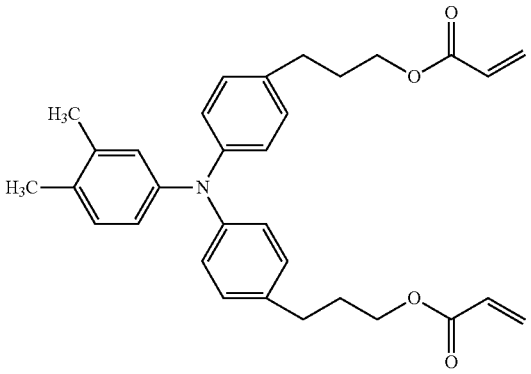

Formula (B-3)

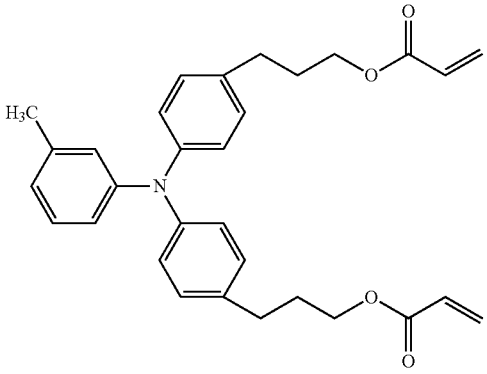

Formula (B-4)

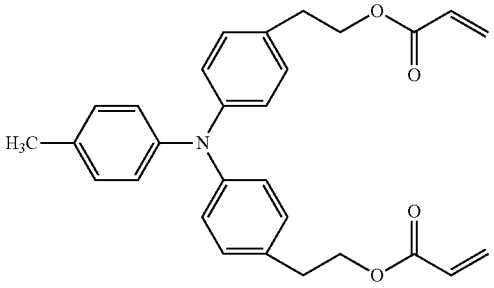

-continued

Formula (B-5)

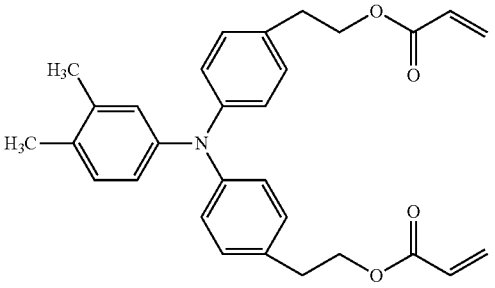

Formula (B-6)

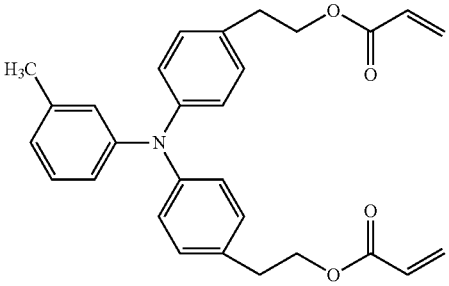

The protective layer may contain additives such as an antioxidant, an ultraviolet absorber, a plasticizer, a leveling agent, a slipperiness-imparting agent and an abrasion resistance-improving agent. Specific examples include hindered phenol compounds, hindered amine compounds, sulfur compounds, phosphorus compounds, benzophenone compounds, siloxane-modified resin, silicone oil, a fluororesin particle, a polystyrene resin particle, a polyethylene resin particle, a silica particle, an alumina particle and a boron nitride particle.

The protective layer may further contain an electro-conductive particle and/or a charge transport substance, and a resin.

Examples of the electro-conductive particle include particles of metal oxides such as titanium oxide, zinc oxide, tin oxide and indium oxide.

Examples of the charge transport substance include polycyclic aromatic compounds, heterocyclic compounds, hydrazone compounds, styryl compounds, enamine compounds, benzidine compounds, triarylamine compounds and resins having groups derived from these substances. Among these, the triarylamine compounds and the benzidine compounds are preferable.

Examples of the resin include polyester resin, acrylic resin, phenoxy resin, polycarbonate resin, polystyrene resin, phenolic resin, melamine resin and epoxy resin. Especially the polycarbonate resin, the polyester resin and the acrylic resin are preferable.

The total amount of the structure represented by formula I and the structure represented by formula II in the protective layers is preferably 50% or more, and more preferably 70% or more based on the total mass of the protective layer.

The average film thickness of the protective layer is preferably 0.5 μm or more and 10 μm or less, and preferably 1 μm or more and 7 μm or less from the viewpoint of electrophotographic characteristics. Particularly, it is preferable that the sum of the average film thicknesses of the protective layer and the charge transport layer are 10 μm or more and 17 μm or less, and the ratio of the average film thickness of the protective layer to the sum of the average film thicknesses of the protective layer and the charge transport layer is 10% or more and 30% or less.

A detailed method for manufacturing a protective layer in an electrophotographic photosensitive member of the present disclosure will be described below.

The protective layer is formed by preparing a coating liquid for a protective layer containing the above-mentioned materials and a solvent, forming a coating film of the coating liquid for a protective layer, and then drying and/or curing the coating film. Any solvent can be used as the solvent used for the coating liquid for a protective layer as long as the solvent is a solvent which can dissolve or disperse the above-mentioned materials. However, examples of the solvent include alcohol solvents, ketone solvents, ether solvents, sulfoxide solvents, ester solvents, and aromatic hydrocarbon solvents.

The monomers having the polymerizable functional groups corresponding to the structure represented by formula I and the structure represented by formula II in the coating liquid for a protective layer is subjected to polymerization and crosslinking (hereinafter also simply called "polymerization") by a well-known polymerization method. Examples of the polymerization method include methods using thermal polymerization reaction, in which heat is used, photopolymerization reaction, in which light such as visible light and ultraviolet rays is used, and radiation polymerization reaction, in which radiations such as an electron beam and gamma rays are used. A polymerization initiator may be incorporated into the coating liquid for a protective layer in any method if needed. Above all, a method using radiation polymerization reaction, which does not need a polymerization initiator particularly, especially polymerization reaction, in which an electron beam is used, is preferable. It is because a protective layer having a very high-purity three-dimensional matrix can be formed by polymerizing monomers having the polymerizable functional groups corresponding to the structure represented by formula I and the structure represented by formula II without using a polymerization initiator. An electrophotographic photosensitive member having such a protective layer exhibits satisfactory electrophotographic characteristics. The polymerization by an electron beam among radiations does very little damage to the electrophotographic photosensitive member by irradiation, and can exhibit satisfactory electrophotographic characteristics.

Irradiation with an electron beam can be performed using an electron beam irradiation apparatus such as a scanning type, an electrocurtain type, a broad beam type, a pulse type or a laminar type. The accelerating voltage of an electron beam is preferably 40 kV or more and 70 kV or less. The electron beam absorbed dose of the surface of a coated film is preferably in the range of 5 kGy or more and 45 kGy or less. It is preferable that the distance between the surface of the coated film and the irradiation window foil of the electron beam irradiation apparatus is 10 mm or more and 40 mm or less.

It is preferable to heat the coated film after the polymerization of the monomers having the polymerizable functional groups corresponding to the structure represented by formula I and the structure represented by formula II. When the heating temperature is too high, the material of the electrophotographic photosensitive member may deteriorate. Therefore, it is preferable to perform heating so that the temperature of the irradiated object is 150° C. or less. Meanwhile, when the heating temperature is too low, the polymerization of the monomers having the polymerizable functional groups corresponding to the structure represented by formula I and the structure represented by formula II does not proceeds sufficiently. Therefore, it is preferable to perform heating so that the temperature of the coated film is 100° C. or more.

Moreover, it is preferable to perform heating for 5 seconds or more and 60 seconds or less while the temperature is raised, and it is more preferable to raise the temperature from the temperature of the coated film after electron beam irradiation to the above-mentioned heating temperature within the heating time.

Although the atmosphere at the time of irradiation with an electron beam and heating the irradiated object may be any of the air atmosphere, inert gas such as nitrogen or helium, and a vacuum, inert gas or a vacuum is preferable from the viewpoint that radical inactivation by oxygen can be suppressed. The oxygen concentration of the atmosphere at the time of irradiation with an electron beam and heating the irradiated object is preferably 300 ppm or less.

The average film thickness of the protective layer of the electrophotographic photosensitive member is preferably 10 μm or less, and more preferably 7 μm or less from the viewpoint of electrophotographic characteristics. Meanwhile, the average film thickness of the protective layer is preferably 0.5 μm or more, and more preferably 1 μm or more from the viewpoint of the durability of the electrophotographic photosensitive member.

[Process Cartridge and Electrophotographic Apparatus]

A process cartridge of the present disclosure integrally supports the electrophotographic photosensitive member described above and at least one unit selected from the group consisting of a charging unit, a development unit and a cleaning unit and is detachably attachable to the main body of an electrophotographic apparatus.

An electrophotographic apparatus of the present disclosure has the electrophotographic photosensitive member described above, the charging unit, an exposure unit, the development unit and a transfer unit.

An example of a schematic configuration of an electrophotographic apparatus having a process cartridge including an electrophotographic photosensitive member is illustrated in FIGURE.

First, reference numerals in FIGURE will be described.

Reference numeral 1 denotes an electrophotographic photosensitive member, reference numeral 2 denotes a shaft, reference numeral 3 denotes a charging unit, reference numeral 4 denotes exposure light, reference numeral 5 denotes a development unit, reference numeral 6 denotes a transfer unit, reference numeral 7 denotes a transfer material, reference numeral 8 denotes a fixing unit, reference numeral 9 denotes a cleaning unit, and reference numeral 10 denotes pre-exposure light. Reference numeral 11 denotes a process cartridge, and reference numeral 12 denotes guiding units.

A cylindrical electrophotographic photosensitive member 1 is driven rotationally at a predetermined circumferential speed in the direction of an arrow around a shaft 2. The surface of the electrophotographic photosensitive member 1 is charged at predetermined positive or negative potential by a charging unit 3. In the FIGURE, although a roller charging method by the roller-shaped charging member is illustrated, a charging method such as a corona charging method, a proximity electrification method or an injection charging method may be adopted. The surface of a charged electrophotographic photosensitive member 1 is irradiated with exposure light 4 from an exposure unit (not illustrated), and the electrostatic latent image corresponding to target image information is formed. The electrostatic latent image formed on the surface of the electrophotographic photosensitive member 1 is developed with toner stored in a development unit 5, and a toner image is formed on the surface of the electrophotographic photosensitive member 1. The toner image formed on the surface of electrophotographic photosensitive member 1 is transferred to a transfer material 7 by a transfer unit 6. The transfer material 7 to which the toner image is transferred is conveyed to a fixing unit 8, subjected to the fixing treatment of the toner image, and printed out of the electrophotographic apparatus. The electrophotographic apparatus may have a cleaning unit 9 for removing a deposit such as toner remaining on the surface of electrophotographic photosensitive member 1 after transfer. A so-called cleanerless system in which no cleaning unit is provided separately, but the above-mentioned deposit is removed by the development unit or the like may be used. The electrophotographic apparatus may have a discharging mechanism which subjects the surface of electrophotographic photosensitive member 1 to discharge treatment by pre-exposure light 10 from a pre-exposure unit (not illustrated). To detach a process cartridge of the present disclosure from the main body of the electrophotographic apparatus, guiding units 12 such as rails may be provided.

An electrophotographic photosensitive member of the present disclosure can be used for laser beam printers, LED printers, copying machines, facsimiles, multifunctional machines thereof and the like.

EXAMPLES

The present disclosure will be described in further detail hereinafter using Examples and Comparative Examples. The present disclosure is not limited at all by the following Examples as long as the invention does not exceed the gist thereof. In the description of the following Examples, "part" is based on mass unless otherwise specified.

<Manufacturing of Electrophotographic Photosensitive Member>

Example 1

An aluminum cylinder (JIS-A3003, aluminium alloy) measuring 24 mm in diameter and 257.5 mm in length was used as a support (electro-conductive support).

Next, a sand mill using 450 parts of glass beads of 0.8 mm in diameter was charged with 214 parts of a titanium oxide ($TiO_2$) particle covered with oxygen-deficient tin oxide ($SnO_2$) as a metal oxide particle (230 nm in average primary particle size), 132 parts of phenolic resin (the monomer/oligomer of phenolic resin) (trade name: Plyophen J-325, manufactured by DIC Corporation, resin solid content: 60% by mass) as a binder material and 98 parts of 1-methoxy-2-propanol as a solvent. The mixture was subjected to dispersion treatment under the conditions where number of revolutions: 2000 rpm, dispersion treatment time: 4.5 hours, and set temperature of cooling water: 18° C. to obtain a dispersion. The glass beads were removed from this dispersion through a mesh (opening size: 150 μm).

A surface-roughening material was added to the dispersion so that the concentration of the surface-roughening material was 10% by mass based on the total mass of the metal oxide particle and the binder material in the dispersion after the glass beads were removed. A silicone resin particle (trade name: Tospearl 120, manufactured by Momentive Performance Materials Inc., 2 μm in average particle diameter) was used as the surface-roughening material. Silicone oil (trade name: SH28PA, produced by Dow Corning Toray Co., Ltd.) as a leveling agent was added to the dispersion so that the concentration of the silicone oil was 0.01% by mass based on the total mass of the metal oxide particle and the binder material in the dispersion. Next, a mixed solvent of methanol and 1-methoxy-2-propanol (mass ratio 1:1) was added to the dispersion so that the total mass of the metal oxide particle, the binder material and the surface-roughening material in the dispersion (namely, mass of solid content) was 67% by mass based on the mass of the dispersion. A coating liquid for an electro-conductive layer was prepared by stirring the mixture.

An electro-conductive layer having an average film thickness of 30 μm was formed by subjecting the support to dip coating with this coating liquid for an electro-conductive layer and heating this for 1 hour at 140° C.

Next, 4 parts of an electron transport substance represented by the formula (E-1), 5.5 parts of blocked isocyanate (trade name: DURANATE SBN-70D, produced by Asahi Kasei Chemicals Corporation), 0.3 parts of polyvinyl butyral resin (trade name: S-LEC KS-5Z, produced by SEKISUI CHEMICAL CO., LTD.) and 0.05 parts of zinc (II) hexanoate (produced by Mitsuwa Chemicals Co., Ltd.) as a catalyst were dissolved in a mixed solvent of 50 parts of tetrahydrofuran and 50 parts of 1-methoxy-2-propanol to prepare a coating liquid for an undercoating layer. An undercoating layer having an average film thickness of 0.7 μm was formed by subjecting the electro-conductive layer to dip coating with this coating liquid for an undercoating layer and heating this for 30 minutes at 170° C.

Formula (E-1)

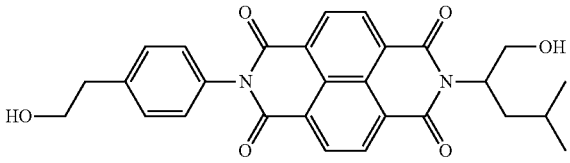

Next, 10 parts of crystalline hydroxygallium phthalocyanine having peaks at 7.5° and 28.4° in a chart obtained by CuKα characteristic X-ray diffraction and 5 parts of polyvinyl butyral resin (trade name: S-LEC BX-1, produced by SEKISUI CHEMICAL CO., LTD.) were added to 200 parts of cyclohexanone. The mixture was dispersed for 6 hours with a sand mill apparatus using glass beads of 0.9 mm in diameter. Then, 150 parts of cyclohexanone and 350 parts of ethyl acetate were further added to this, and diluted the mixture to obtain a coating liquid for a charge-generating layer. A charge-generating layer having an average film thickness of 0.20 μm was formed by subjecting the undercoating layer to dip coating with the obtained coating liquid and drying the coating film at 95° C. for 10 minutes. The measurement of X-ray diffraction was performed under the following conditions.

[Powder X-Ray Diffraction Measurement]

Measuring machine used: X-ray diffraction apparatus RINT-TTR II manufactured by Rigaku Corporation, X-ray tube: Cu Tube voltage: 50 kV Tube current: 300 mA
Scanning method: 2θ/θ scan
Scanning speed: 4.0°/min
Sampling interval: 0.02°
Start angle (2θ): 5.0°
Stop angle (2θ): 40.0°
Attachment: Standard sample holder
Filter: Not used
Incident monochrome: Used
Counter monochrome meter: Not used
Divergence slit: Open
Divergence vertical limit slit: 10.00 mm
Scattering slit: Open
Light-receiving slit: Open
Flat plate monochromator: Used
Counter: Scintillation counter Next, a coating liquid for a charge transport layer was prepared by dissolving 6 parts of a compound (charge transport substance (hole transport compound)) represented by the following formula (C-1), 3 parts of a compound (charge transport substance (hole transport compound)) represented by the following formula (C-2), 1 part of a compound (charge transport substance (hole transport compound)) represented by the following formula (C-3), 10 parts of polycarbonate (trade name: Iupilon Z400, produced by Mitsubishi Engineering-Plastics Corporation), and 0.02 parts of polycarbonate resin having copolymerization units represented by the following formula (C-4) and the following formula (C-5) (x/y=0.95/0.05: viscosity average molecular weight=20000) in a mixed solvent of 25 parts of orthoxylene/25 parts of methyl benzoate/25 parts of dimethoxymethane. A charge transport layer having an average film thickness of 12 μm was formed by subjecting the charge-generating layer to dip coating with this coating liquid for a charge transport layer, forming a coating film and drying the coating film for 30 minutes at 120° C.

Formula (C-1)

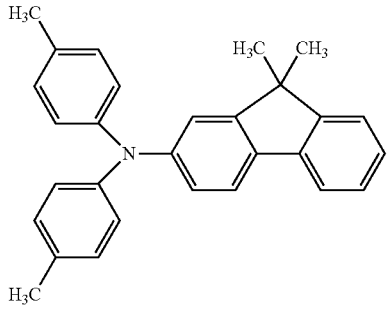

Formula (C-2)

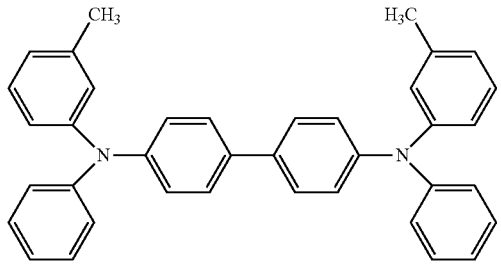

-continued

Formula (C-3)

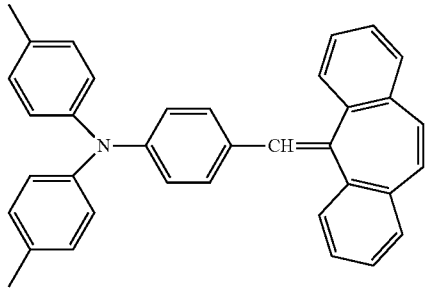

Formula (C-4)

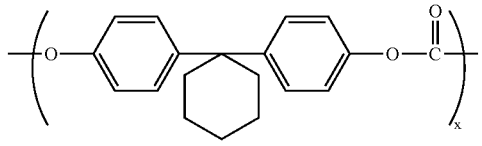

Formula (C-5)

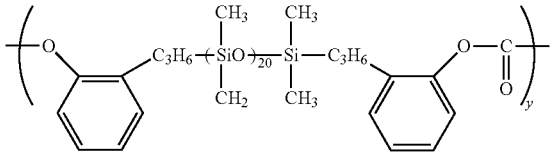

Next, 10 parts of a compound represented by formula A-5, 10 parts of a compound represented by formula B-2, 50 parts of 1-propanol, 25 parts of 1,1,2,2,3,3,4-heptafluorocyclopentane (trade name: ZEORORA H, manufactured by Zeon Corporation) were mixed and stirred. A coating liquid for a protective layer was prepared by then filtering this solution through a Polyflon filter (trade name: PF-020, manufactured by Advantec Toyo Kaisha, Ltd.).

The charge transport layer was subjected to dip coating with this coating liquid for a protective layer to form a coating film. The obtained coating film was dried for 6 minutes at 50° C. Then, the coating film was irradiated with the electron beam in a nitrogen atmosphere under the conditions where the accelerating voltage of an electron beam was 60 kV, and the beam current was 5.0 mA for 2.8 seconds with the distance between the surface of the support and the irradiation window foil of electron beam irradiation adjusted to 20 mm while the support (object to be irradiated) was rotated at a speed of 200 rpm. When the electron beam absorbed dose of the surface of a coated film at this time was measured by the above-mentioned method, the electron beam absorbed dose was 15 kGy. Then, the coating film was heated in a nitrogen atmosphere by raising the temperature from 25° C. to 117° C. over 40 seconds. The oxygen concentration from the electron beam irradiation to the subsequent heat treatment was 10 ppm or less. Next, natural cooling was performed in the air atmosphere until the temperature of the coating film reached 25° C., and heat treatment was performed for 30 minutes on the condition that the temperature of the coating film was 105° C. to form a protective layer having an average film thickness of 3 μm. Thus, the electrophotographic photosensitive member having the protective layer was manufactured. Thus, the cylindrical (drum-shaped) electrophotographic photosensitive member 1 of Example 1 having the support, the undercoating layer, the charge-generating layer, the charge transport layer and the protective layer in this order was manufactured.

Examples 2 to 33

An electrophotographic photosensitive member was manufactured in the same way as in Example 1 except that the compound represented by formula A-5 and the compound represented by formula B-2 (polymerizable monomers), the accelerating voltage of an electron beam, the distance between the surface of the support and the irradiation window foil of electron beam irradiation (irradiation distance), the electron beam absorbed dose of the coated film (absorbed dose), the electron beam irradiation time, the final temperature in the curing by heating (the heating final temperature) and temperature rise time as well as the oxygen concentration in the irradiation with an electron beam and the curing by heating, the average film thickness of the charge transport layer and the average film thickness of the protective layer were changed as illustrated in table 1 in Example 1.

The beam current was changed to 7 mA in Examples 26 to 28, and the beam current was changed to 6 mA in Example 29.

Comparative Example 1

In Example 1, a protective layer was produced, and a protective layer described in Example 1 was then formed on the protective layer again to manufacture an electrophotographic photosensitive member having a layered protective layer.

Comparative Examples 2 to 10

An electrophotographic photosensitive member was manufactured in the same way as in Example 1 except that the compound represented by formula A-5 and the compound represented by formula B-2 (polymerizable monomers), the accelerating voltage of an electron beam, the electron beam absorbed dose of the coated film (absorbed dose), the electron beam irradiation time, the final temperature in the curing by heating (the heating final temperature) and temperature rise time as well as the oxygen concentration in the irradiation with an electron beam and the curing by heating were changed as illustrated in table 1 in Example 1

TABLE 1

| | Electron beam irradiation conditions | | | | | | | | | Polymerizable monomer | | | |
|---|---|---|---|---|---|---|---|---|---|---|---|---|---|
| | Accelerating voltage [kV] | Irradiation distance [mm] | Absorbed dose [kGy] | Irradiation time [s] | Heating final temperature [° C.] | Temperature rise time [s] | Oxygen concentration [ppm] | Film thickness of charge transport layer [μm] | Film thickness of protective layer [μm] | Structure | Parts | Structure | Parts |
| Example 1 | 60 | 20 | 15 | 2.8 | 117 | 40 | 10 | 12.0 | 3.0 | A-5 | 10 | B-2 | 10 |
| Example 2 | 60 | 20 | 15 | 2.8 | 117 | 40 | 10 | 12.0 | 3.0 | A-9 | 10 | B-2 | 10 |
| Example 3 | 60 | 20 | 15 | 2.8 | 117 | 40 | 10 | 12.0 | 3.0 | A-10 | 10 | B-2 | 10 |
| Example 4 | 60 | 20 | 15 | 2.8 | 117 | 40 | 10 | 12.0 | 3.0 | A-5 | 16 | B-2 | 4 |
| Example 5 | 60 | 20 | 15 | 2.8 | 117 | 40 | 10 | 12.0 | 3.0 | A-5 | 6 | B-2 | 14 |
| Example 6 | 60 | 20 | 15 | 2.8 | 117 | 7 | 10 | 7.0 | 3.0 | A-5 | 10 | B-2 | 10 |
| Example 7 | 60 | 20 | 15 | 2.8 | 117 | 40 | 10 | 12.0 | 5.0 | A-5 | 10 | B-2 | 10 |
| Example 8 | 60 | 20 | 15 | 2.8 | 117 | 40 | 10 | 9.0 | 1.0 | A-5 | 10 | B-2 | 10 |
| Example 9 | 60 | 20 | 15 | 2.8 | 117 | 60 | 10 | 15.0 | 2.0 | A-5 | 10 | B-2 | 10 |
| Example 10 | 60 | 20 | 15 | 2.8 | 117 | 40 | 10 | 13.0 | 5.0 | A-5 | 10 | B-2 | 10 |
| Example 11 | 60 | 20 | 15 | 2.8 | 117 | 40 | 10 | 6.0 | 2.0 | A-5 | 10 | B-2 | 10 |
| Example 12 | 60 | 20 | 15 | 2.8 | 117 | 40 | 10 | 10.0 | 5.0 | A-5 | 10 | B-2 | 10 |
| Example 13 | 60 | 20 | 15 | 2.8 | 117 | 40 | 10 | 14.0 | 1.0 | A-5 | 10 | B-2 | 10 |
| Example 14 | 60 | 20 | 15 | 2.8 | 100 | 30 | 10 | 12.0 | 3.0 | A-5 | 10 | B-2 | 10 |
| Example 15 | 40 | 20 | 15 | 4.2 | 117 | 25 | 10 | 12.0 | 3.0 | A-5 | 10 | B-2 | 10 |
| Example 16 | 70 | 20 | 25 | 1.2 | 117 | 10 | 10 | 12.0 | 3.0 | A-5 | 10 | B-2 | 10 |
| Example 17 | 60 | 20 | 15 | 2.8 | 117 | 40 | 10 | 12.0 | 3.0 | A-6 | 10 | B-2 | 10 |
| Example 18 | 60 | 20 | 15 | 2.8 | 117 | 40 | 10 | 12.0 | 3.0 | A-5 | 10 | B-6 | 10 |
| Example 19 | 40 | 20 | 15 | 4.2 | 127 | 40 | 10 | 12.0 | 3.0 | A-6 | 10 | B-2 | 10 |
| Example 20 | 70 | 40 | 15 | 1.6 | 127 | 40 | 10 | 12.0 | 3.0 | A-6 | 10 | B-2 | 10 |
| Example 21 | 55 | 15 | 5 | 1.6 | 150 | 40 | 10 | 12.0 | 3.0 | A-5 | 10 | B-2 | 10 |
| Example 22 | 60 | 20 | 45 | 8.4 | 100 | 40 | 10 | 12.0 | 3.0 | A-5 | 10 | B-2 | 10 |
| Example 23 | 60 | 20 | 15 | 2.8 | 117 | 40 | 700 | 12.0 | 3.0 | A-5 | 10 | B-2 | 10 |
| Example 24 | 70 | 30 | 17 | 1.8 | 117 | 40 | 10 | 12.0 | 3.0 | A-5 | 10 | B-2 | 10 |
| Example 25 | 70 | 40 | 15 | 1.2 | 117 | 40 | 10 | 16.5 | 1.5 | A-5 | 10 | B-2 | 10 |
| Example 26 | 40 | 10 | 18 | 4.5 | 117 | 40 | 10 | 16.5 | 1.5 | A-5 | 10 | B-2 | 10 |
| Example 27 | 45 | 40 | 5 | 8.2 | 128 | 40 | 10 | 16.5 | 1.5 | A-5 | 10 | B-2 | 10 |
| Example 28 | 50 | 20 | 20 | 5.8 | 117 | 45 | 10 | 12.0 | 3.0 | A-5 | 10 | B-2 | 10 |
| Example 29 | 55 | 40 | 12 | 7.5 | 137 | 25 | 10 | 12.0 | 3.0 | A-5 | 10 | B-2 | 10 |
| Example 30 | 45 | 10 | 30 | 1.9 | 105 | 45 | 10 | 12.0 | 3.0 | A-5 | 10 | B-2 | 10 |
| Example 31 | 45 | 40 | 10 | 15.2 | 145 | 5 | 10 | 12.0 | 3.0 | A-5 | 10 | B-2 | 10 |
| Example 32 | 60 | 20 | 15 | 2.8 | 117 | 5 | 10 | 12.0 | 3.0 | A-5 | 10 | B-2 | 10 |
| Example 33 | 60 | 20 | 15 | 2.8 | 117 | 80 | 10 | 12.0 | 3.0 | A-5 | 10 | B-2 | 10 |
| Comparative Example 1 | 60 | 20 | 12 | 2.0 | 117 | 40 | 10 | 12.0 | 3.0 | A-5 | 10 | B-2 | 10 |
| Comparative Example 2 | 60 | 20 | 15 | 2.8 | 117 | 40 | 10 | 12.0 | 3.0 | O-1 | 10 | B-2 | 10 |

TABLE 1-continued

| | Electron beam irradiation conditions | | | | | | | | | Polymerizable monomer | | | |
|---|---|---|---|---|---|---|---|---|---|---|---|---|---|
| | Accelerating voltage [kV] | Irradiation distance [mm] | Absorbed dose [kGy] | Irradiation time [s] | Heating final temperature [° C.] | Temperature rise time [s] | Oxygen concentration [ppm] | Film thickness of charge transport layer [μm] | Film thickness of protective layer [μm] | Structure | Parts | Structure | Parts |
| Comparative Example 3 | 60 | 20 | 15 | 2.8 | 117 | 40 | 10 | 12.0 | 3.0 | O-2 | 10 | B-2 | 10 |
| Comparative Example 4 | 70 | 30 | 18 | 1.6 | 117 | 40 | 10 | 12.0 | 3.0 | A-5 | 19 | B-2 | 1 |
| Comparative Example 5 | 60 | 20 | 15 | 2.8 | 117 | 40 | 10 | 12.0 | 3.0 | A-5 | 5 | B-2 | 15 |
| Comparative Example 6 | 60 | 20 | 30 | 5.6 | 117 | 40 | 10 | 12.0 | 3.0 | B-6 | 10 | B-2 | 10 |
| Comparative Example 7 | 80 | 20 | 35 | 2.8 | 117 | 40 | 1000 | 12.0 | 3.0 | A-5 | 10 | B-2 | 10 |
| Comparative Example 8 | 100 | 20 | 80 | 5.6 | 137 | 10 | 1000 | 12.0 | 3.0 | A-5 | 10 | B-2 | 10 |
| Comparative Example 9 | 100 | 20 | 80 | 5.6 | 137 | 60 | 10 | 12.0 | 3.0 | A-5 | 10 | B-2 | 10 |
| Comparative Example 10 | 100 | 20 | 15 | 1.4 | 117 | 80 | 10 | 12.0 | 3.0 | A-5 | 10 | B-2 | 10 |

In table 1, O-1 and O-2 are compounds represented by the following formula O-1 and formula O-2, respectively.

Formula (O-1)

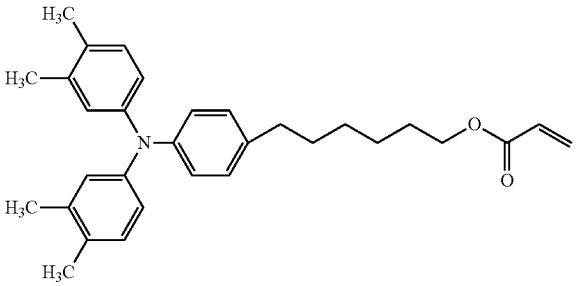

Formula (O-2)

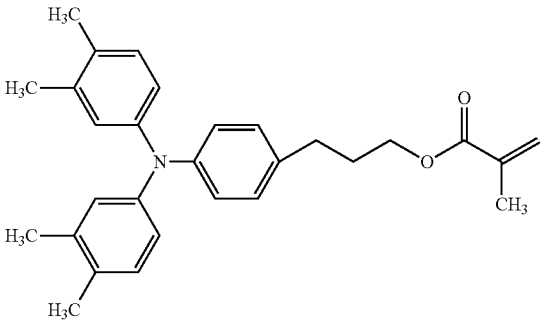

[Evaluation]

1. Measurement of a Value

The A value was measured in the following procedure as to each of the protective layers of the manufactured electrophotographic photosensitive members.

A protective layer was exfoliated together with a photosensitive layer from the obtained electrophotographic photosensitive member by cutting open the protective layer in the longitudinal direction with a razor. The film of a charge transport layer remaining on the side on which the interface between the protective layer and the charge transport layer exists is removed completely with chlorobenzene. Then, a sample for measurement was obtained by performing natural drying. The value of A1 determined from the side on which the surface of the protective layer existed and the value of A2 determined from the side on which the interface of the protective layer with the charge transport layer existed were measured under the following conditions using this sample. The evaluation result is illustrated in Table 2. Each of the value of A1 and the value of A2 illustrated in Table 2 is the average value of values measured at a total of 12 points which are 3 points in the longitudinal direction of the sample for measurement by 4 points in the circumferential direction.

(Measurement Conditions)

Apparatus: FT/IR-420 (manufactured by JASCO Corporation)

Attached apparatus: ATR apparatus

IRE: Ge

Incidence angle: 45 degrees

Number of integration times: 32

2. Evaluation of Adhesive Force of Protective Layer

As an evaluation machine, a laser beam printer (trade name: HP LaserJet Enterprise 600 M603, manufactured by Hewlett-Packard Company, non-contact development method, printing speed: A4 in the longitudinal direction 60 sheets/minute) was modified as illustrated below, and the adhesive force was evaluated. To maintain (control) the interval between the electrophotographic photosensitive member and a developing roller (sleeve), 4 mm wide rotatable cylindrical spacing members made of a POM material were brought in contact with points which were around 9 mm away from the upper and lower ends of a cylinder on which the electrophotographic photosensitive member is formed recognized as the centers. The contact forces of both upper end and the lower end the photosensitive member were 2,300 gf. The image formation region in this system was from a location which is around 20 mm away from the upper end of the cylinder to a location which is around 20 mm away from the lower end.

Images were formed on 100,000 sheets under such conditions in the environment of a temperature of 5° C. and a humidity of 10% RH by an intermittent mode in which the printer stopped every time images having a printing ratio of 1% were formed on 2 sheets of A4 size plain paper. The light part potential (Vl) when the laser intensity was set as 0.3 cJ/m$^2$, and the dark part potential (Vd) of the photosensitive member was set as −700V was measured, and a halftone image was then outputted and evaluated every time 1,000 sheets were printed. The evaluation result is shown in Table 2.

TABLE 2

| | A1 value | A2 value | A1/A2 | Film thickness ratio | Image evaluation |
|---|---|---|---|---|---|
| Example 1 | 0.005 | 0.015 | 0.33 | 20 | Good |
| Example 2 | 0.012 | 0.020 | 0.60 | 20 | Good |
| Example 3 | 0.016 | 0.020 | 0.80 | 20 | Slight black spots due to loose films occur at the time of 150000 sheets. |
| Example 4 | 0.006 | 0.028 | 0.21 | 20 | Slight black spots due to loose films occur at the time of 100000 sheets. |
| Example 5 | 0.023 | 0.024 | 0.96 | 20 | Slight black spots due to loose films occur at the time of 100000 sheets. |
| Example 6 | 0.014 | 0.021 | 0.67 | 30 | Good |
| Example 7 | 0.014 | 0.024 | 0.58 | 29 | Good |
| Example 8 | 0.005 | 0.010 | 0.50 | 10 | Good |
| Example 9 | 0.003 | 0.008 | 0.38 | 12 | Good |
| Example 10 | 0.014 | 0.022 | 0.64 | 28 | Slight black spots due to loose films occur at the time of 120000 sheets. |
| Example 11 | 0.014 | 0.018 | 0.78 | 25 | Slight black spots due to loose films occur at the time of 100000 sheets. |
| Example 12 | 0.014 | 0.022 | 0.64 | 33 | Slight black spots due to loose films occur at the time of 130000 sheets. |
| Example 13 | 0.014 | 0.017 | 0.82 | 7 | Slight black spots due to loose films occur at the time of 95000 sheets. |
| Example 14 | 0.021 | 0.024 | 0.88 | 20 | Slight black spots due to loose films occur at the time of 100000 sheets. |
| Example 15 | 0.015 | 0.025 | 0.60 | 20 | Slight black spots due to loose films occur at the time of 105000 sheets. |
| Example 16 | 0.003 | 0.015 | 0.20 | 20 | Slight black spots due to loose films occur at the time of 120000 sheets. |
| Example 17 | 0.022 | 0.024 | 0.92 | 20 | Slight black spots due to loose films occur at the time of 100000 sheets. |
| Example 18 | 0.015 | 0.025 | 0.60 | 20 | Slight black spots due to loose films occur at the time of 95000 sheets. |
| Example 19 | 0.020 | 0.024 | 0.83 | 20 | Slight black spots due to loose films occur at the time of 150000 sheets. |
| Example 20 | 0.016 | 0.021 | 0.76 | 20 | Slight black spots due to loose films occur at the time of 150000 sheets. |
| Example 21 | 0.021 | 0.027 | 0.78 | 20 | Slight black spots due to loose films occur at the time of 100000 sheets. |
| Example 22 | 0.009 | 0.018 | 0.50 | 20 | Good |
| Example 23 | 0.023 | 0.027 | 0.85 | 20 | Slight black spots due to loose films occur at the time of 100000 sheets. |
| Example 24 | 0.016 | 0.020 | 0.80 | 20 | Slight black spots due to loose films occur at the time of 150000 sheets. |
| Example 25 | 0.015 | 0.020 | 0.75 | 8 | Slight black spots due to loose films occur at the time of 90000 sheets. |
| Example 26 | 0.019 | 0.027 | 0.70 | 8 | Slight black spots due to loose films occur at the time of 80000 sheets. |

TABLE 2-continued

| | A1 value | A2 value | A1/A2 | Film thickness ratio | Image evaluation |
|---|---|---|---|---|---|
| Example 27 | 0.019 | 0.026 | 0.73 | 8 | Slight black spots due to loose films occur at the time of 80000 sheets. |
| Example 28 | 0.010 | 0.018 | 0.56 | 8 | Slight black spots due to loose films occur at the time of 120000 sheets. |
| Example 29 | 0.012 | 0.019 | 0.63 | 8 | Slight black spots due to loose films occur at the time of 110000 sheets. |
| Example 30 | 0.010 | 0.019 | 0.53 | 8 | Slight black spots due to loose films occur at the time of 100000 sheets. |
| Example 31 | 0.015 | 0.020 | 0.75 | 8 | Slight black spots due to loose films occur at the time of 110000 sheets. |
| Example 32 | 0.017 | 0.028 | 0.61 | 20 | Slight black spots due to loose films occur at the time of 80000 sheets. |
| Example 33 | 0.003 | 0.015 | 0.20 | 20 | Slight black spots due to loose films occur at the time of 85000 sheets. |
| Comparative Example 1 | 0.017 | 0.017 | 1.00 | 20 | A vertical streak due to loose films occurs at the time of 10000 sheets. |
| Comparative Example 2 | 0.025 | 0.028 | 0.89 | 20 | A vertical streak due to loose films occurs at the time of 10000 sheets. |
| Comparative Example 3 | 0.014 | 0.020 | 0.70 | 20 | Black spots due to loose films occurs at the time of 5000 sheets. |
| Comparative Example 4 | 0.007 | 0.009 | 0.78 | 20 | Black spots due to loose films occurs at the time of 5000 sheets. |
| Comparative Example 5 | 0.028 | 0.034 | 0.82 | 20 | A vertical streak due to loose films occurs at the time of 10000 sheets. |
| Comparative Example 6 | 0.023 | 0.027 | 0.85 | 20 | Black spots due to loose films occurs at the time of 10000 sheets. |
| Comparative Example 7 | 0.035 | 0.041 | 0.85 | 20 | A vertical streak due to loose films occurs at the time of 1000 sheets. |
| Comparative Example 8 | 0.011 | 0.011 | 1.00 | 20 | Black spots due to loose films occurs at the time of 2000 sheets. |
| Comparative Example 9 | 0.005 | 0.005 | 1.00 | 20 | Film exfoliation occurs at the time of 2000 sheets. |
| Comparative Example 10 | 0.012 | 0.012 | 1.00 | 20 | Film exfoliation occurs at the time of 2000 sheets. |

In table 2, the film thickness ratio is a ratio of the average film thickness of the protective layer to the sum of the average film thicknesses of the charge transport layer and the protective layer (%).

As described above by mentioning the embodiments and the Examples, an electrophotographic photosensitive member in which image defects due to film exfoliation does not occur through long-term use can be provided according to the present disclosure.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-105587, filed May 31, 2018, which is hereby incorporated by reference herein in its entirety.

What is claimed is:

1. An electrophotographic photosensitive member, comprising:

an electro-conductive support, a layered photosensitive layer and a single-layer protective layer in this order; and the protective layer comprising a structure represented by formula I and a structure represented by formula II (I)

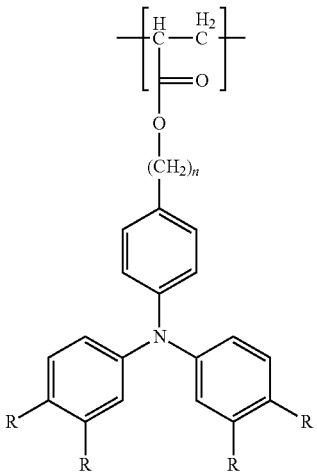

(II)

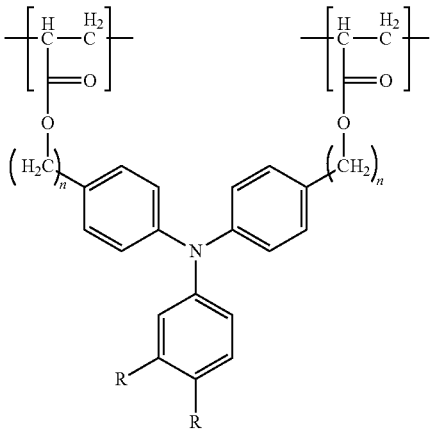

where each R is independently a hydrogen atom or a methyl group, and each n is independently an integer of 2 to 5, wherein the structure represented by formula I is comprised in the protective layer at a mass ratio of 20 to 240% based on the structure represented by formula II, and an A value determined by total reflection Fourier transform infrared spectroscopy under conditions where an internal reflection element is Ge, and an incidence angle is 45° and expressed by A=S1/S2 satisfies expressions (2) to (4)

$$0.003 \leq A1 \leq 0.023, \quad (2)$$

$$0.005 \leq A2 \leq 0.030, \quad (3) \text{ and}$$

$$0.2 \leq A1/A2 \leq 0.97$$

where S1 is a peak area based on in-plane bending vibration of terminal olefin, S2 is a peak area based on stretching vibration of C═O of acryloyloxy groups, A1 is an A value determined from a surface side of the electrophotographic photosensitive member in the protective layer, and A2 is an A value determined from a side on which an interface with the layered photosensitive layer exists in the protective layer.

2. The electrophotographic photosensitive member according to claim 1, wherein the layered photosensitive layer comprises a charge-generating layer and a charge transport layer, a sum of average film thicknesses of the protective layer and the charge transport layer is 10 to 17 μm, and a ratio of the average film thickness of the protective layer to the sum of average film thicknesses of the protective layer and the charge transport layer is 10 to 30%.

3. The electrophotographic photosensitive member according to claim 1, wherein the A value of the protective layer satisfies $$0.003 \leq A1 \leq 0.020,$$

$$0.008 \leq A2 \leq 0.024, \text{ and}$$

$$0.3 \leq A1/A2 \leq 0.85.$$

4. A method for manufacturing the electrophotographic photosensitive member according to claim 1, comprising the steps of:

preparing a coating liquid for the protective layer;

applying the coating liquid to said support bearing said photosensitive layer to form a coated film;

irradiating the coated film with an electron beam at an oxygen concentration of 300 ppm or less; and curing the coated film to form said protective layer by heating at an oxygen concentration of 300 ppm or less, wherein in the irradiation with an electron beam, an accelerating voltage of the electron beam is 40 to 70 kV, and a distance between a surface of the coated film and an irradiation window foil of an electron beam irradiation apparatus is 10 to 40 mm such that an electron beam absorbed dose of the surface of the coated film is 5 to 45 kGy, and in the curing by heating, a final temperature of heating temperature is 100 to 150° C.

5. The method for manufacturing an electrophotographic photosensitive member according to claim 4, wherein in the curing by heating the heating is performed for a temperature rise time of 5 to 60 seconds.

6. A process cartridge integrally supporting an electrophotographic photosensitive member comprising an electroconductive support, a layered photosensitive layer and a single-layer protective layer in this order, and at least one unit selected from the group consisting of a charging unit, a development unit and a cleaning unit, and being detachably attachable to a main body of an electrophotographic apparatus, the protective layer comprising a structure represented by formula I and a structure represented by formula II (I)

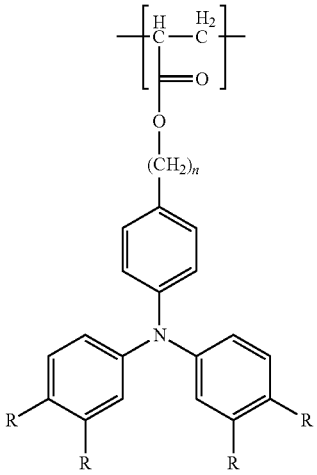

(II)

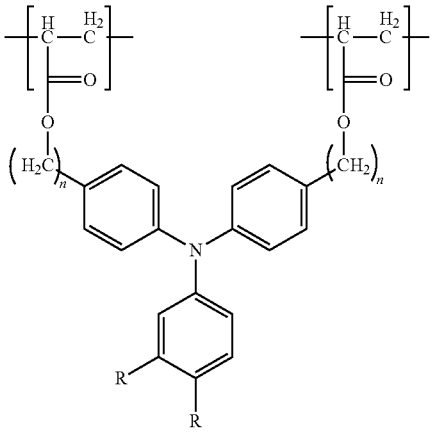

where each R is independently a hydrogen atom or a methyl group, and each n is independently an integer of 2 to 5, wherein the structure represented by formula I is comprised in the protective layer at a mass ratio of 20 to 240% based on the structure represented by formula II, and an A value determined by total reflection Fourier transform infrared spectroscopy under conditions where an internal reflection element is Ge, and an incidence angle is 45° and expressed by A=S1/S2 satisfies expressions (2) to (4)

$$0.003 \leq A1 \leq 0.023, \quad (2)$$

$$0.005 \leq A2 \leq 0.030, \quad (3) \text{ and}$$

$$0.2 \leq A1/A2 \leq 0.97$$

where S1 is a peak area based on in-plane bending vibration of terminal olefin, S2 is a peak area based on stretching vibration of C=O of acryloyloxy groups, A1 is an A value determined from a surface side of the electrophotographic photosensitive member in the protective layer, and A2 is an A value determined from a side on which an interface with the layered photosensitive layer exists in the protective layer.

7. An electrophotographic image-forming apparatus, comprising:

an electrophotographic photosensitive member comprising an electro-conductive support, a layered photosensitive layer and a single-layer protective layer in this order; and at least one unit selected from the group consisting of a charging unit, an exposure unit, a development unit and a transfer unit, the protective layer comprising a structure represented by formula I and a structure represented by formula II, (I)

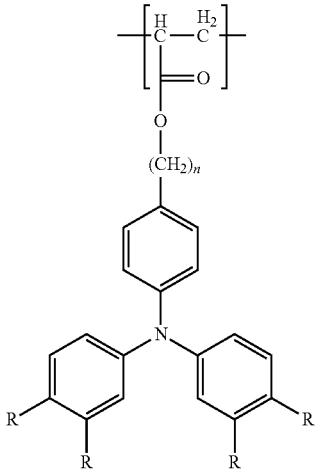

(II)

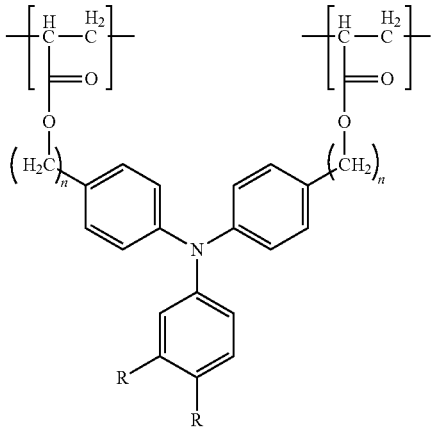

where each R is independently a hydrogen atom or a methyl group, and each n is independently an integer of 2 to 5, wherein the structure represented by formula I is comprised in the protective layer at a mass ratio of 20 to 240% based on the structure represented by formula II, and an A value determined by total reflection Fourier transform infrared spectroscopy under conditions where an internal reflection element is Ge, and an incidence angle is 45° and expressed by A=S1/S2 satisfies expressions (2) to (4)

$$0.003 \leq A1 \leq 0.023, \quad (2)$$

$$0.005 \leq A2 \leq 0.030, \quad (3) \text{ and}$$

$$0.2 \leq A1/A2 \leq 0.97$$

where S1 is a peak area based on in-plane bending vibration of terminal olefin, S2 is a peak area based on stretching vibration of C═O of acryloyloxy groups, A1 is an A value determined from a surface side of the electrophotographic photosensitive member in the protective layer, and A2 is an A value determined from a side on which an interface with the layered photosensitive layer exists in the protective layer.

* * * * *